United States Patent [19]

McFarland

[11] Patent Number: 4,678,154

[45] Date of Patent: Jul. 7, 1987

[54] HOLDER FOR BEVERAGE CONTAINERS AND THE LIKE

[76] Inventor: Joseph R. McFarland, 507 Palo Alto Dr., Vancouver, Wash. 98661

[21] Appl. No.: 856,593

[22] Filed: Apr. 25, 1986

[51] Int. Cl.[4] ..... A47K 1/08

[52] U.S. Cl. ..... 248/311.2; 229/1.5 H; 248/300

[58] Field of Search ..... 248/311.2, 310, 309.1, 248/314, 300, 174, 247; 206/478, 479; 220/85 H; 229/1.5 H; 150/52 R

[56] References Cited

U.S. PATENT DOCUMENTS

| | | | |
|---|---|---|---|
| 2,227,428 | 1/1941 | Amberg et al. | 229/1.5 H |
| 2,265,679 | 12/1941 | Sunderhauf | 248/174 |
| 2,831,647 | 4/1958 | MacKay | 248/311.2 X |
| 2,876,276 | 3/1959 | Melton | 248/314 X |
| 2,924,090 | 2/1960 | Schneller | 248/300 X |
| 2,979,301 | 4/1961 | Reveal | 248/311.2 X |
| 3,031,162 | 4/1962 | Whorton | 248/311.2 X |
| 3,104,788 | 9/1963 | Wood | 294/52 |
| 3,128,983 | 4/1964 | Wood | 248/311.2 |
| 3,365,761 | 1/1968 | Kalvig | 248/314 X |
| 4,557,452 | 12/1985 | Khuong | 248/311.2 X |

*Primary Examiner*—Ramon O. Ramirez

*Attorney, Agent, or Firm*—Chernoff, Vilhauer, McClung & Stenzel

[57] ABSTRACT

A beverage container holder including an upper arm which extends upwardly and a pair of lateral arms connected with the upper arm which are bent to form a frusto-conical cup-holding receptacle whose size is adjustable through the use of a series of slots in which a hook can be engaged. A tongue extends through a respective one of a second series of slots to prevent undesired relative movement of the two cup-holding arms. A spacer is foldable away from the cup-holding arms to stabilize the beverage container holder when it is suspended alongside a vertical surface. The beverage container holder can be inverted, with the lateral arms joined to form a cylindrical, can-holding, receptacle, and the upper arm used to stabilize the holder by being gripped between seat cushions of a motor vehicle.

15 Claims, 7 Drawing Figures

FIG. 7
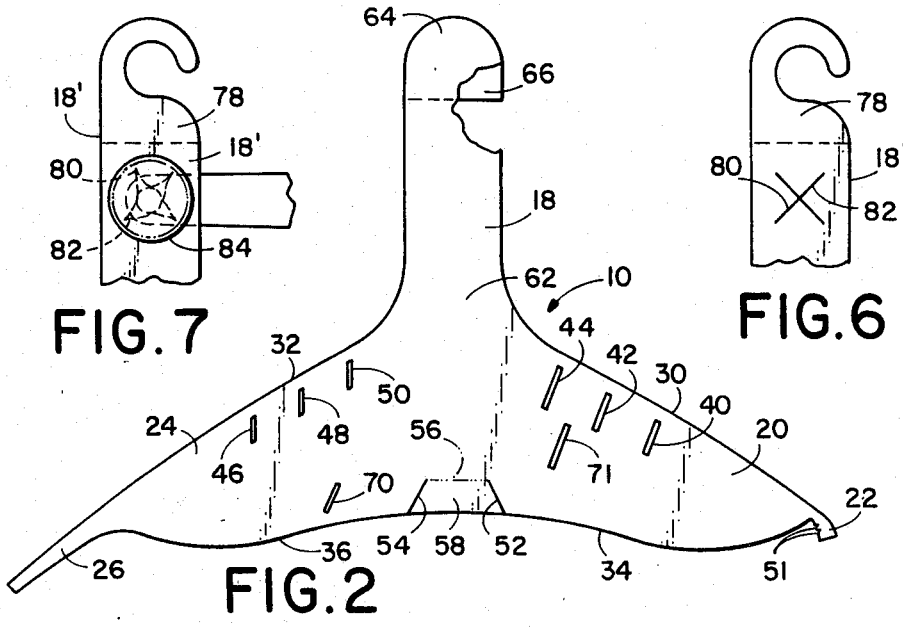
FIG. 2
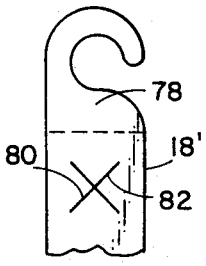
FIG. 6
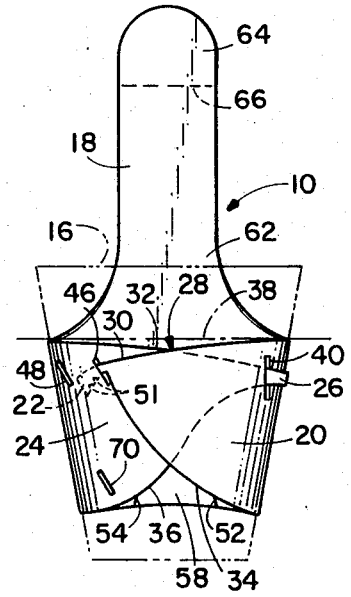
FIG. 3
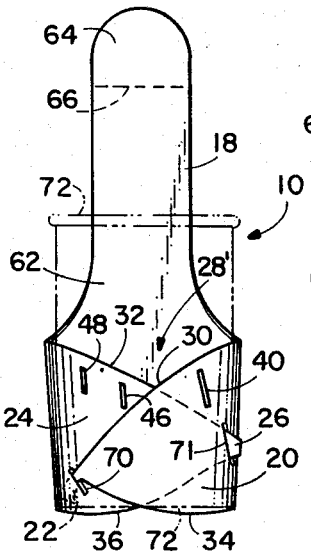
FIG. 4
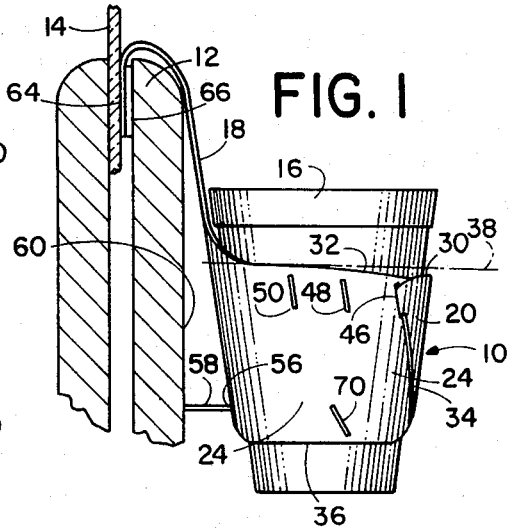
FIG. 1
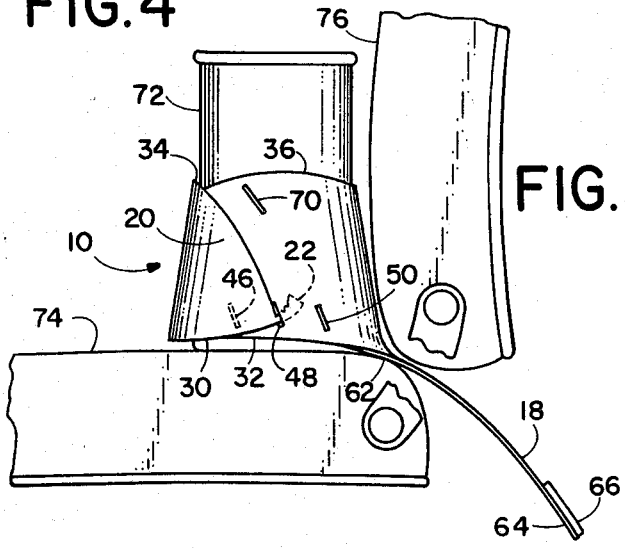
FIG. 5

HOLDER FOR BEVERAGE CONTAINERS AND THE LIKE

BACKGROUND OF THE INVENTON

The present invention relates to devices for holding beverage containers, and particularly to a holder constructed of flexible sheet material for holding beverage cups and soft drink cans, and particularly adapted for use in motor vehicles.

It is often desirable to have beverages within reach in containers from which they can be drunk by the operator of a motor vehicle. Nevertheless, it is often clumsy and may be dangerous for the operator of such a motor vehicle to hold a beverage container in his hand.

Particularly when a beverage is purchased along with food in drive-in restaurants, it is desirable to be able to place the beverage container in a holder which will prevent it from spilling in a motor vehicle, thereby damaging upholstery or clothing or causing distraction which might be dangerous to the operation of a motor vehicle. It may be desirable at other times to be able to carry a beverage container on one's person without encumbering one's hands.

Whorton U.S. Pat. No. 3,031,162 discloses a device for holding beverage containers in motor vehicles. The Whorton carrier is adjustable in size and is assembled of folded sheet material, but is more complex than is desirable.

U.S. Pat. Nos. 3,104,788 Wood and 2,979,301 Reveal disclose holders for cups which include strips of sheet material which wrap around a frusto-conical cup to hold it. Reveal discloses a cup holder including a tab which may be inserted into an appropriate one of a series of slots extending circumferentially of the cup, while Wood discloses a holder having a notched tab which fits through a central hole to form a pair of cup holding loops side by side, with the circumference of each loop being determined by choice of the appropriate notch.

While the cup holders disclosed by Whorton and Reveal are useful to some extent for holding a cup safely in an automobile, none of the prior art known to the applicant discloses a holder which at the option of the user is useable either to hold a beverage container attached securely to the door of a motor vehicle, or to hold it stably in some other location, such as resting on the passenger seat of a vehicle, in a way which will prevent spillage of a beverage from the container.

What is desired then, is a holder for beverage containers and the like which is inexpensive enough to be given away with sales of beverages in disposable containers, which can be shipped and stored in a compact form, which is easily assembled for use, and which can be securely attached to a commonly available location within an automobile or on one's person to hold an open container securely enough to avoid spillage, yet allow the container to be picked up so that the beverage can be drunk. It is also desirable to provide such a beverage container holder which will accept beverage containers of different sizes.

SUMMARY OF THE INVENTION

The present invention provides a holder for beverage containers which overcomes the shortcomings and disadvantages of previously known devices of this sort and which is useable to hold an open beverage container safely and conveniently in a motor vehicle. The beverage container holder of the present invention is useful to hold frusto-conical containers such as paper cups of several different sizes, and is also useful for holding cylindrical containers such as soft-drink cans, as well.

The holder of the present invention is constructed of a piece of flexible but stiff sheet material, such as a plastic sheet or flexible cardboard, cut into a three-armed shape, and is inexpensive enough to be given away with beverages purchased at fast-food and drive-in restaurants.

The holder according to a preferred embodiment of the present invention is a three-armed sheet of sheet material, of which a first or upper arm includes a stiffened end portion which can be placed extending downward between the upper inside rail of the solid lower part of a vehicle door and the window glass, to suspend the holder. The first arm may be folded similarly over a person's belt to carry a container of a beverage, leaving the person's hands free. Alternatively, the first arm may be placed extending rearwardly between the seat cushion and the back cushion of the passenger seat of a motor vehicle, to hold a beverage container within reach of the driver of the vehicle.

The other two arms of the beverage container holder of the invention extend laterally away from each other, substantially perpendicular to the first arm, and may be wrapped around a beverage container. A tapered tongue on the third one of the arms is mated with an appropriate one of several slots in the second of the arms, while a hook on the end of the second arm is engaged in an appropriate one of several slots in the third arm, securing the arms in the form of a receptacle of the appropriate size, for holding a cup or a beverage can.

It is therefore a principal object of the present invention to provide an inexpensive and safe holder which is easy to assemble from a flat piece of material of the appropriate shape to hold a beverage container securely.

It is another important object of the present invention to provide a holder which is inexpensive enough to be given away along with beverages purchased at fast-food and drive-in restaurants.

It is an important feature of the present invention that it provides a beverage container holder having a plurality of slots in one arm and a hook on another arm which can be engaged in appropriate one of the slots to form a receptacle having the required size and either a cylindrical or frusto-conical shape, so as to receive any of a variety of different containers.

Another feature of the present invention is the provision of a spacer to help support the holder in an upright attitude when it is suspended alongside the door of a vehicle.

It is an important advantage of the beverage container holder of the present invention that it is adaptable more readily to various sizes and shapes of beverage containers than previously known holders for the same purpose.

It is another object of the present invention to provide such a beverage holder which is useful for carrying a beverage container on the user's person.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a beverage container holder according to the present invention, in use supporting a beverage cup on the door of a motor vehicle.

FIG. 2 is a plan view of the beverage container holder of the present invention in unassembled flat sheet form.

FIG. 3 is a front view of the beverage container holder shown in FIG. 1, showing the holder configured to hold a frusto-conical beverage cup.

FIG. 4 is a front view of the beverage container holder shown in FIG. 1, with the arms thereof arranged to define a nearly cylindrical can-holding receptacle.

FIG. 5 is a view of the beverage container holder shown in FIG. 1, in the configuration similar to that shown in FIG. 3, in use holding a beverage can on the seat of an automobile.

FIG. 6 is a view of the distal portion of an upper arm of an alternative embodiment of the beverage container holder of the invention.

FIG. 7 is a view of the portion of a beverage holder container shown in FIG. 6, showing the device attached to a window crank knob of an automobile door.

DETAILED DESCRIPTION OF THE DRAWINGS

Referring now to the drawings, a beverage container holder 10 embodying the present invention is shown in FIG. 1 suspended from the top of the inside panel of an automobile door 12 including a roll-up window 14. A frusto-conical beverage cup 16 is held upright in the holder 10, which is securely suspended from the door 12 by a first, or upper arm 18. A pair of cup-holding lateral arms 20 and 24 extend oppositely from the upper arm 18. Preferably, the entire cup holder 10 is a unitary sheet of material cut to the appropriate shape, as is shown in FIG. 2, with a first one 20 of the lateral arms including a hook portion 22 at its outer end, while the second one 24 of the lateral arms has a tapered elongate tongue 26 as its terminal portion. The beverage container holder 10 may be fashioned of an appropriately strong and flexible cardboard, or of a polyethylene or polypropylene plastic sheet material of appropriate thickness and strength.

As is shown in FIG. 1, the arms 20 and 24 encircle the cup 16, defining a frusto-conical, upwardly-open cup receptacle space 28.

Referring to FIG. 2, it will be apparent that the arms 20 and 24 have a respective upper edges 30, 32, and respective bottom edge portions 34, 36. The upper edges 30 and 32 are arcuate, as may be seen in FIG. 2, both lying substantially along parts of the same arc, so that when the arms 20 and 24 are bent to form the frusto-conical receptacle space 28 shown in FIG. 1, the majority of each of the upper edges 30 and 32 lies substantially along a plane 38 indicated in FIGS. 1 and 3.

A first set of apart-spaced slots, including slots 40, 42, and 44, are defined in the first cup-holding arm 20, extending diagonally downward and inward toward the middle of the holder 10. The slots 40, 42, and 44 are parallel with each other and approximately perpendicular to the upper edge 30 and are spaced a small distance, such as $\frac{3}{8}$ inch, apart from the upper edge 30.

Located spaced apart from one another along the upper edge 32 of the second cup holding arm 24 are a second group of slots 46, 48 and 50, extending generally vertically and parallel with each other. As will be appreciated upon examining FIGS. 1 and 3, the hook 22 fits into a selected one of the slots 46, 48, and 50, while the tongue 26 extends outwardly through a correspondingly located one of the first group of slots 40, 42, and 44, with a portion of the arm 20 overlapping a portion of the arm 24. The slots 40, 42, and 44 are of different lengths, so that during assembly of the cup holder 10 the tongue 26 can be inserted through each one of the slots 40, 42, and 44 to an extent limited by the length of the particular one of the slots. The slot 44 is therefore longer than the slot 42, which in turn is longer than the slot 40. The position of the tongue 26 fully inserted into one of the slots 40, 42 and 44, in turn, permits the hook 22 to be engaged in the proper one of the slots 46, 48, and 50. The tongue 26 is then held snugly within the selected one of the slots 40, 42, and 44, appropriately limiting relative movement of the arm 24 with respect to the arm 20 and preventing the hook 22 from becoming disengaged from the selected one of the slots 46, 48 and 50 unintentionally when the cup holder 10 is assembled as shown in FIGS. 1 and 3. The hook 22 includes at least two small notches 51, which help to prevent the hook 22 from being dislodged from its position in a selected one of the slots 46, 48, and 50, to regulate the size of the cup-holding receptacle space 28 more precisely.

A pair of cuts 52 and 54 extend diagonally upward and toward each other from the bottom edges 34 and 36, respectively, and a fold line 56 extends between the upper ends of the cuts 52 and 54, generally parallel with the bottom edges 34 and 36, defining a spacer tab 58 which may be bent out from the plane of the sheet of material of which the beverage container holder 10 is made, in order to stabilize the beverage container holder 10 as shown in FIG. 1, by resting against a vertical surface 60 of the automobile door 12 to which the beverage container holder 10 is attached as shown in FIG. 1.

The upper arm 18 includes a proximal end 62 adjoining the arms 20 and 24, and a distal end 64. The distal end portion of the first arm 18 is stiffened, as by the attachment of a stiffener 66, which may be an adhesively attached additional layer of the same sheet material of which the beverage container holder 10 is made. The distal end 64 can be pushed down into the space available between the window 14 and the upper edge rail 12 of the automobile door, as shown in FIG. 1. However, since the stiffener 66 prevents the distal end portion 64 from bending, the upper arm 18 is kept engaged between the window 14 and the upper part of the door 12. It will be appreciated, of course, that the stiffened distal end portion 64 is also useful for suspending the beverage container holder 10 from other available supports, for example, a person's waistband or trousers belt, so that a container of a beverage can be carried on the person without encumbering one's hands unnecessarily.

Referring now to FIG. 4, it will be seen that the hook 22 is engaged in a slot 70 spaced a short distance away from the bottom edge 36 of the arm 24, holding the arms 20 and 24 arcuately bent into a nearly cylindrical configuration defining a receptacle space 28' whose shape is appropriate for holding a cylindrical beverage container such as a soft drink can 72 without it being able to wobble excessively. The soft drink can 72 can fit snugly in the receptacle space 28' without being able to fall through. The slot 70 is preferably oriented diagonally with respect to the bottom edge 36, so that the upper edge 30 extends generally perpendicularly toward the slot 70 when the hook 22 is engaged in the slot 70 as shown in FIG. 4. With the arms 20 and 24 bent into this configuration and retained by engagement of the hook 22 in the slot 70 the tongue 26 should be engaged in the slot 71 defined in the arm 20.

The configuration of the beverage container holder 10 shown in FIG. 3 is also useful as shown in FIG. 5 to hold a beverage container, particularly a soft drink can 72, with the beverage container resting upright on the seat cushion 74 of an automobile seat. In this use of the beverage container holder 10, the upper arm 18 extends rearwardly and downwardly between the seat cushion 74 and the back rest 76. The seat thus resiliently presses against the upper arm 18, preventing movement of the soft drink container 72 relative to the vehicle, and preventing the soft drink container 72 from overturning as a result of movement of the vehicle. Because the upper edges 30 and 32 of the arms 20 and 24 rest on the seat cushion 74, when the beverage container holder 10 is used as shown in FIG. 5, the soft drink can 72 can easily be removed from and replaced within the receptacle space 28.

Instead of the distal end portion 64 shown in FIGS. 1–5, the beverage container holder 10 may be equipped with an alternative a first or upper arm 18' as shown in FIGS. 6 and 7, having a different distal end portion including a hook 78 useable to suspend the beverage container holder 10 from a portion of the interior of a motor vehicle, or from any similarly available projection which would permit the beverage container holder 10 to hang downwardly alongside a generally vertical surface. Additionally, a pair of perpendicularly intersecting slits 80 and 82 permit the arm portion 18' to be forced over the knob 84 of a window crank in a motor vehicle to support the beverage container holder 10 conveniently. The hook portion 78 may, like the distal end portion 64, be constructed as a double thickness of the material of which the holder 10 is made to provide a desired amount of additional stiffness in the hook 78.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A holder for beverage containers and the like, of flexible sheet material having a generally three-armed shape when flat, comprising:

(a) a first arm having a distal portion and a proximal portion;

(b) a second arm extending laterally with respect to said first arm and being connected with said proximal portion of said first arm, said second arm having a hook portion;

(c) a third arm extending generally oppositely away from said second arm and being connected with said proximal portion of said first arm, said third arm including a tapered tongue portion extending away from said second arm;

(d) first slot means defined in said second arm for adjustably receiving said tapered tongue portion therein; and (e) second slot means defined in said third arm for selectively receiving and holding said hook portion of said second arm with said second and third arms configured to encircle a beverage container as a generally frusto-conical receptacle in a selected one of a plurality of sizes.

2. The holder of claim 1, said distal portion of said first arm including a stiffener and said proximal portion of said first arm being more flexible than said distal portion.

3. The holder of claim 2, said stiffener comprising an additional layer of said flexible sheet material attached to and extending alongside and in contact with said flexible sheet material of said distal portion of said first arm.

4. The holder of claim 1, each of said second and third arms having a respective bottom edge, said bottom edges including means for defining a spacer tab foldably movable to a position extending away from said second and third arms.

5. The holder of claim 1, said third arm thereof including a bottom edge and defining third slot means, located between said second slot means and said bottom edge, for selectively receiving said hook portion to hold said second and third arms so that said receptacle defines a nearly cylindrical space.

6. The holder of claim 1, said second slot means including a plurality of parallel slot spaced apart from one another along said third arm for receiving said hook portion so as to define said receptacle in a plurality of sizes.

7. The holder of claim 1 wherein said second and third arms each have a top edge, respective major portions of said top edges being located along a common arc, said major portions falling substantially in a single plane when said hook portion is engaged in said second slot means.

8. The holder of claim 1, said second and third arms having respective bottom edges, and said second and third arms including a pair of cuts extending upwardly away from said bottom edges and a fold line extending between said cuts and located spaced apart from said bottom edges, defining spacer means for holding said beverage container receptacle spaced apart from an adjacent surface.

9. The holder of claim 1 wherein said first slot means includes a first plurality of slots having different respective lengths corresponding to the width of said tongue portion at respective different locations therealong, so as to limit the distance to which said tongue portion may be inserted into each respective one of said plurality of slots.

10. The holder of claim 9 wherein said second slot means includes a second plurality of slots located in said third arm and spaced apart from one another therealong, the width of said tongue at respective locations along its length, the respective length and location of each of said first plurality of slots, and the direction in which said tongue extends being interrelated with the locations of respective ones of said second plurality of slots so that said tongue and said hook portion fit, respectively, in corresponding ones of said first and second pluralities of slots to form said different sizes of said receptacle.

11. The holder of claim 1 wherein said first slot means includes a plurality of slots each extending substantially transversely of said second arm.

12. The holder of claim 1, said second slot means including a plurality of slots extending parallel with one another and with said first arm, and said hook portion including a plurality of notch means for engaging said second slot means adjustably.

13. The holder of claim 1, said second arm defining tongue-receiving slot means below said first slot means, and said third arm thereof including a bottom edge and defining third slot means, located between said second slot means and said bottom edge, for selectively receiving said hook portion to hold said second and third arms so that said receptacle defines a nearly cylindrical space.

14. The holder of claim 1, said distal portion of said first arm including means defining a hook for suspending said holder.

15. The holder of claim 1, said distal portion of said first arm having knob-receiving means including a pair of intersecting slits defined in said distal portion.

* * * * *